United States Patent [19]

Lowder et al.

[11] 4,411,351

[45] Oct. 25, 1983

[54] BOTTLE DISPENSING AND CONTROL SYSTEM

[75] Inventors: Marlene Lowder, 3414 San Pablo, San Jose, Calif. 95127; Norman B. Johnson, San Jose, Calif.

[73] Assignee: Marlene Lowder, San Jose, Calif.

[21] Appl. No.: 193,471

[22] Filed: Oct. 3, 1980

[51] Int. Cl.[3] ..... G07F 7/06

[52] U.S. Cl. ..... 194/4 C; 221/82

[58] Field of Search ..... 194/4, 1, 2; 221/2, 221/76, 82, 83, 155, 281

[56] References Cited

U.S. PATENT DOCUMENTS

| | | | |
|---|---|---|---|
| 1,315,879 | 9/1919 | Stoltz et al. | 221/82 |
| 2,219,206 | 10/1940 | De Stefani | 221/83 X |
| 2,245,841 | 6/1941 | Weiss | 194/4 R X |
| 2,344,715 | 3/1944 | Maurer | 194/4 F X |
| 2,687,825 | 8/1954 | Galin et al. | 221/82 |
| 2,694,505 | 11/1954 | Hedges | 221/82 |
| 2,901,145 | 8/1959 | Black | 194/4 E X |
| 2,954,111 | 9/1960 | Garrard | 194/4 C |
| 3,053,412 | 9/1962 | Black et al. | 194/4 F X |
| 3,310,198 | 3/1967 | Regan et al. . | |
| 3,688,947 | 9/1972 | Reichenberger . | |
| 3,753,507 | 8/1973 | James et al. . | |
| 3,766,365 | 10/1973 | Scott . | |
| 3,878,377 | 4/1975 | Brunone . | |
| 3,884,386 | 5/1975 | Urcola . | |
| 4,075,463 | 2/1978 | Eguizabal . | |
| 4,248,334 | 2/1981 | Hanley et al. | 194/4 E X |

*Primary Examiner*—F. J. Bartuska

*Attorney, Agent, or Firm*—Jack M. Wiseman; Francis W. Anderson

[57] ABSTRACT

A system for monitoring the operations of a person, such as a bartender, who has under his control a number of containers, such as bottles of liquor, from which he dispenses individual portions, and for keeping a running inventory of all the containers that are available to the operator at the beginning of a work period. The system includes a work station that has a compartment for retaining an array of containers from which the operator is dispensing portions, a container identifying and disposal unit for receiving empty containers presented to it by the operator, and a storage unit arranged to hold a plurality of containers and dispense one of the containers after the operator presents a similar container to the identifying and disposal unit.

3 Claims, 9 Drawing Figures

BOTTLE DISPENSING AND CONTROL SYSTEM

BACKGROUND OF THE INVENTION

1. Field of the Invention

For many years, one of the problems faced by the managers of taverns and cocktail lounges results from the difficulty of keeping track of the bottles of liquor used by bartenders as they dispense drinks. In a typical establishment, when a bartender empties a bottle, he drops the empty bottle in a trash container and obtains a full bottle from a supply of bottles located nearby. Usually, he does not have to account to anyone for the new full bottles since he may be the only bartender on duty, or he may be one of several bartenders trying to service orders during a very busy period when there is no time for bottle-accounting operations.

The present system provides means for making a full bottle of liquor available to the bartender only after he disposes of an empty bottle containing the very same liquid, and this control means is so coordinated in the system that the dispensing of a full bottle and the recording of the disposal of the empty bottle is initiated by the bartender as he carries out his usual necessary step of disposing of an empty bottle.

2. Description of the Prior Art

Various types of container storing and dispensing devices are now in use. A typical installation is one in which a container having a beverage therein is dispensed when a person inserts a coin in a slot and pushes a control button. Such dispensing machines have been adapted for use in hotel rooms so that the person who has rented the room can select the drink or package of foodstuff that he desires, and actuate a switch or the like to cause the desired article to become available to him. Coins are not required in this type of hotel room dispenser since, as a container is withdrawn from the machine, a signal is sent to a central computing device which applies the proper unit cost to the transaction and makes a record of the transaction so that the hotel cashier can add the cost of all dispensed articles to the bill of the person when he checks out. U.S. Pat. No. 3,310,198, No. 4,075,463 and No. 3,884,386 disclose such systems and the use of central computers for various calculating operations. Central calculating and recording systems are used in the dispensing of fluids as for example in a typical serve-yourself gasoline service station. Such a system is disclosed in U.S. Pat. No. 3,878,377 and a similar system is disclosed in U.S. Pat. No. 3,688,947 which concern an arrangement for monitoring the dispensing of individual portions from liquor bottles by a bartender.

SUMMARY OF THE INVENTION

A full bottle storage and dispenser unit is positioned between an empty bottle identifying-and-disposal unit and a third unit having an open storage space, commonly designated as a "well". The storage unit includes separate, independently operating, modules, each of which is adapted to store bottles of a particular liquor. In use, the bartender services his customers from the bottles in the well and, when a bottle of a particular liquid becomes empty, he inserts that empty bottle in the identifying-and-disposal unit which has a label reader capable of associating the particular label with one of the storage modules and sending a signal to a central control unit. The control unit illuminates a push button at the proper storage module and energizes a circuit whereby the module is readied to dispense a full bottle of the desired liquor when the bartender pushes the illuminated button. Means are provided in the system for electrically interconnecting the separate units so that each unit can send and receive signals from the control unit which may be located at a remote location. The system also includes means for recording various inventory data and for inactivating the entire system during predetermined intervals.

DESCRIPTION OF A PREFERRED EMBODIMENT

Figure 1:
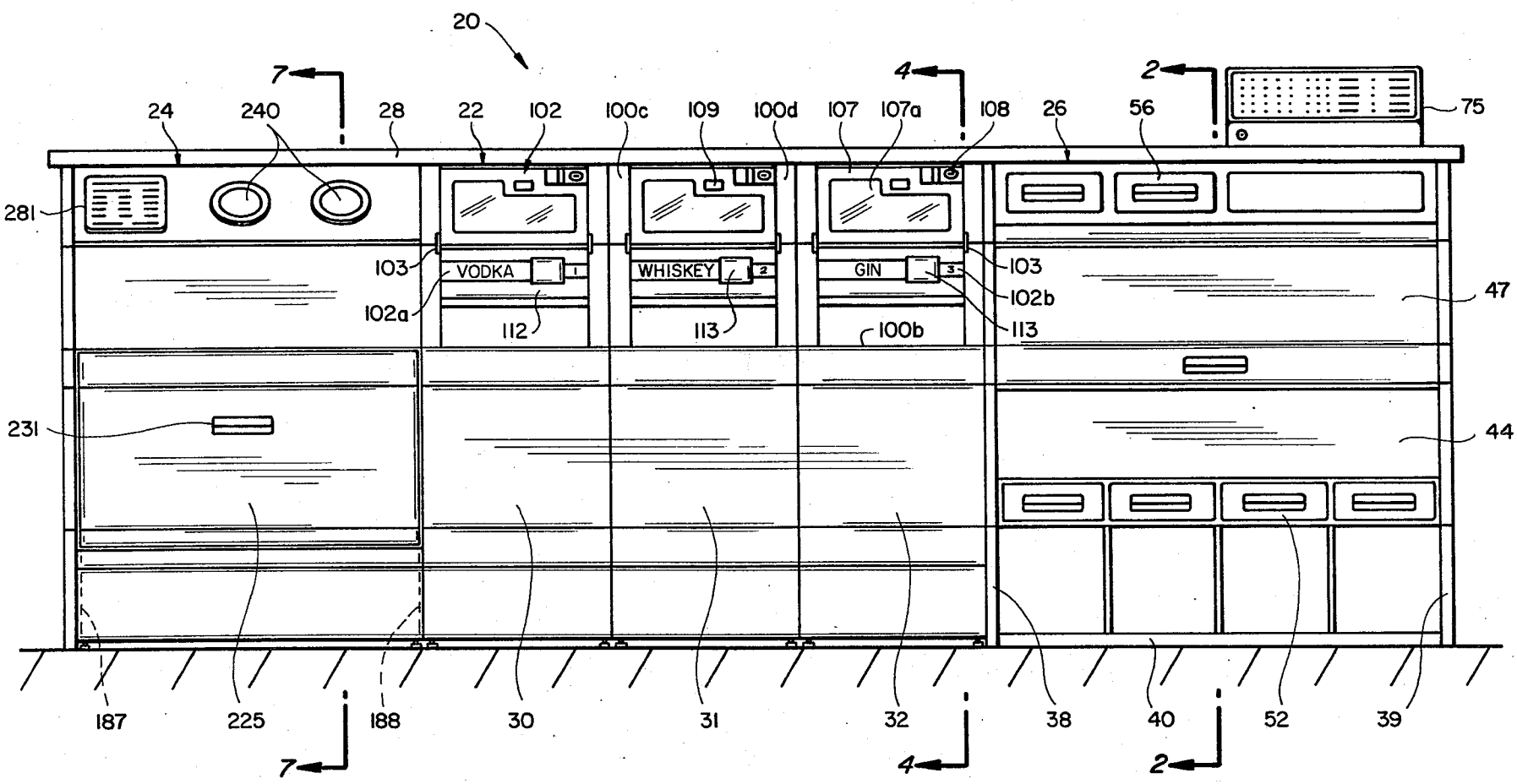
FIG. 1 is a schematic front elevation of a container dispensing and inventory control machine constructed in accordance with the teaching of the present invention.

In FIG. 1 the reference numeral 20 indicates generally a modular system for handling bottle goods, the system including a central storage and dispenser unit 22 in which full bottles of liquor or the like are stored and from which full bottles can be withdrawn selectively, an empty bottle disposal unit 24, and a unit 26 which provides an operator's work station where a single bottle of each liquor available for purchase is kept in a compartment, commonly called a well, in an array such that an operator can conveniently select a particular bottle and dispense individual portions therefrom. The three units are physically separate entities connected only by electrical wiring, a countertop 28 which extends over all three units, and a rear wall 29 (FIG. 2) which is disposed across the back of all three units. The central unit 22 is itself a modular unit, being formed by three side-by-side modules 30-32, each of which is arranged to store a brand or type of liquor different from the liquor in the bottles of the adjacent modules.

In using the system, the bartender dispenses individual drinks from the bottles in the well. When a bottle becomes empty, the bartender deposits it in the disposal unit 24 and obtains a full bottle from unit 22 for replenishing the well. The system includes means for keeping track of the full bottles removed from unit 22 as well as the empty bottles disposed of by unit 24.

Figure 2:
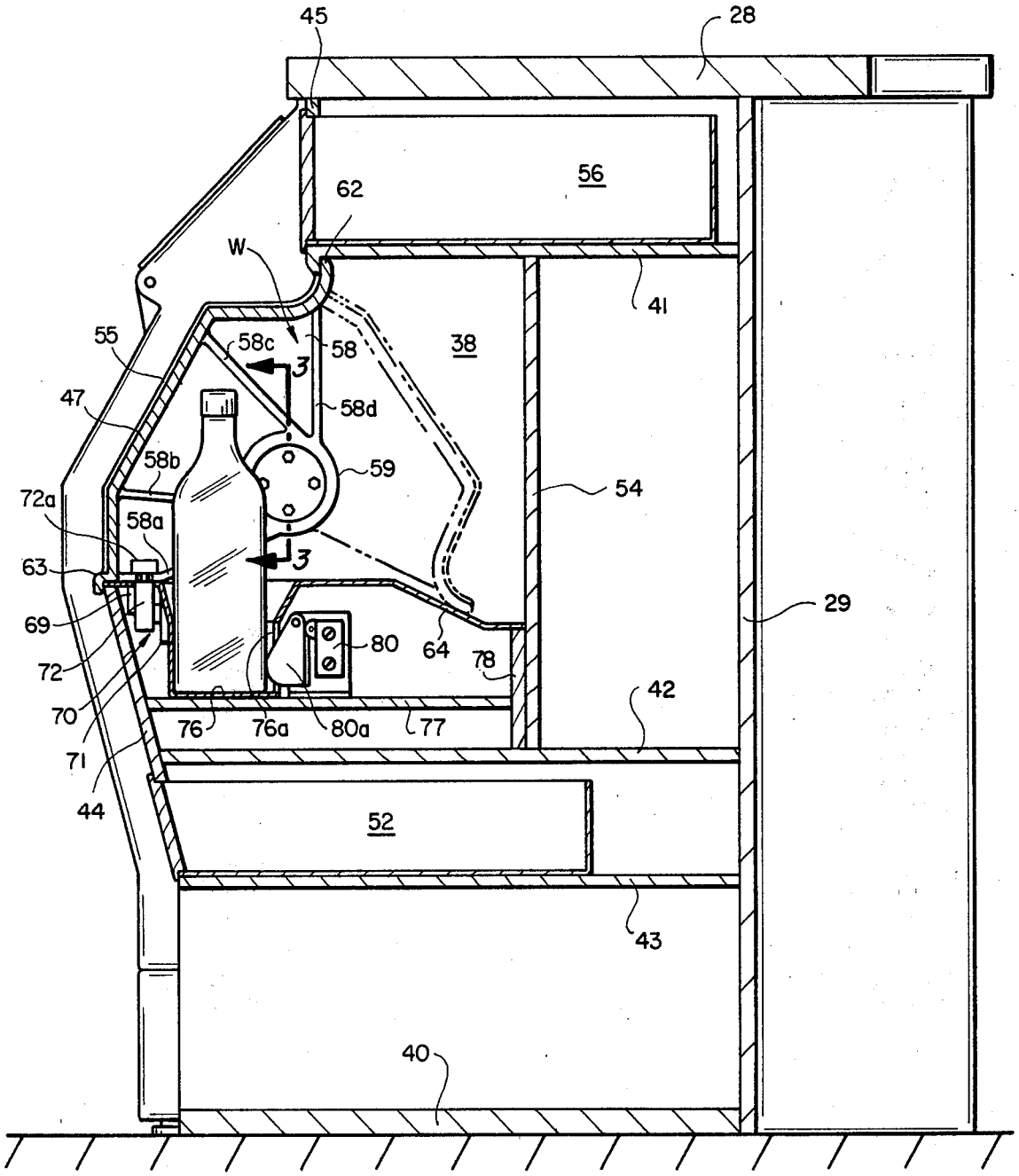
FIG. 2 is a fragmentary vertical section taken along line 2—2 of FIG. 1.

The unit 26 comprises a metal cabinet that has spaced sidewalls 38 and 39 connected by a bottom wall 40 and a plurality of spaced intermediate horizontal walls 41, 42 and 43 (FIG. 2). The cabinet has a front wall made up of lower section 44 and an upper section 45, the section 45 being disposed rearwardly of the section 44 to define an opening in which a door 47 is disposed. The front wall section 45 underlies and abuts the countertop 28, and the walls 40–43 about the rear wall 29. The partitions 42 and 43 cooperate with the sidewalls of the cabinet to define a space in which a plurality of juxtaposed drawers 52 (FIG. 1) are slidably disposed. A vertical partition 54 (FIG. 2) extends between the sidewalls and cooperates with these sidewalls, the horizontal partitions 41 and 42, the front wall and the door 47 to define the well W in which the bottles in use are kept. A storage drawer 56 is slidably disposed in a space provided between the sidewalls, the wall 41 and the countertop 28.

Figure 3:
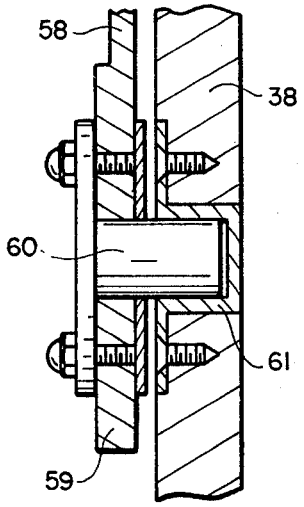
FIG. 3 is an enlarged section taken along line 3—3 of FIG. 2.

The door 47 includes a metal front panel 55 of irregular configuration whose opposite side edges terminate closely adjacent the sidewalls 38 and 39. The door has, at each side, a panel 58 secured to and extending rearwardly from a side edge of the front panel of the door. Each side panel has reinforcing ribs 58*a*–58*d*, which terminates in a circular boss 59, and each boss 59 (one only being shown in FIG. 3) has a stub shaft 60 secured therein. Each stub shaft is rotatably supported in a socket 61 secured in an aperture of one of the sidewalls. The two stub shafts 60 are in axial alignment, and, accordingly, the door 47 is arranged to pivot clockwise (FIG. 2) about the axis defined by the shafts from the closed position shown in solid lines in FIG. 2 to the open position indicated by phantom lines.

The clockwise rotation of the door to open position is limited by a sheet metal wall 64 which is secured in fixed position transversely of the well. The counterclockwise pivoting of the door to closed position is arrested by the engagement of an upper transverse edge portion 62 of the door against the rear surface of the front wall section 45, and by the engagement of a lower transverse edge portion 63 of the door against the wall. It will be noted that a portion of the upper section of the door underlies and slants abruptly away from the area where the upper edge portion 62 of the door engages the wall 45. This arrangement makes it difficult for anyone to use a prybar or the like to force the door open to gain access to the well. Similarly, the overlapping engagement of the lower edge of the door with the wall 44 makes it difficult to pry open the door at that point. A magnetic sensor 69 is mounted on the sidewall 38 immediately behind the upper edge of the door section 44 in position to detect the presence of the metal door when it is in closed position. The sensor is of the type wherein a reed switch, has contacts arranged to be closed by the action of a magnet carried by the edge of the door when the door reaches closed position. When the contacts are closed a circuit is completed for sending a signal to a control panel to indicate that the door is closed. When the door is opened, the circuit is broken.

A rotary latch 70, which is mounted on the sidewall 38 adjacent the door sensor 69, includes a rotary solenoid 71 that has a pin 72 secured to the end of the solenoid shaft. The pin has a reduced diameter portion and an enlarged head 72*a*, the reduced diameter portion being adapted to move into a slot formed in the rib 58*a* of the door panel that is adjacent sidewall 38. When the shaft of the solenoid is swung to the position shown in FIG. 2, the door is locked and the enlarged head of the rotary solenoid is under the control of a timer which is effective to lock the well door during the times when the bar is closed and at other predetermined intervals. As seen in FIG. 1, a cash register 75 may be positioned on the top of unit 26 and, if desired, one or more of the drawers 56 can be designed as a cash drawer.

The wall 64 that extends across the lower end of the well W has a downwardly bent forward portion that defines a trough 76 extending transversely across the well for receiving the bottles from which drinks are to be dispensed. The trough has a flat bottom and upright front and rear walls for supporting the bottles in upright, side-by-side array in the well. If desired, partitions can be erected in the trough to define stations for bottles of different liquor.

The bottom wall of the trough 76 rests on a wall 77 that extends between the sidewalls 38 and 39, and between the front wall section 44 and a transverse plate 78 which extends upwardly from the wall 49. The rear wall of the trough has an opening 76*a* at each bottle station, and an actuator 80*a* of a switch 80 extends through each opening in a position to be contacted by a bottle in the well.

All of the storage modules 30–32 are identical and a description of module 32 will serve to disclose the construction and operation of each of the others.

Figure 5:
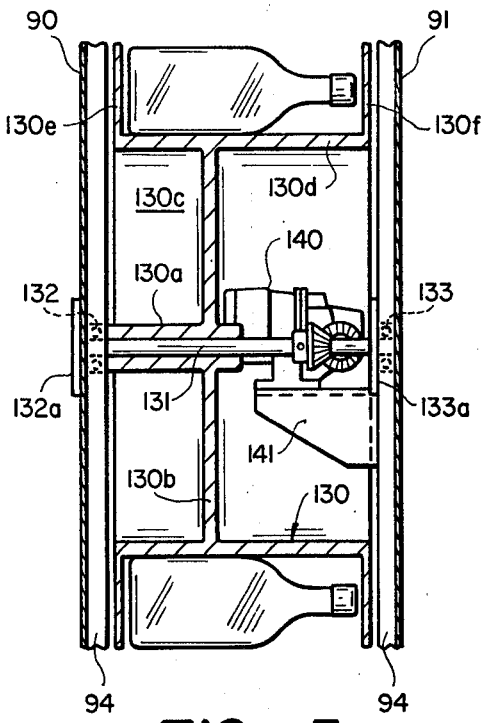
FIG. 5 is a section taken along line 5—5 of FIG. 4.
Figure 4:
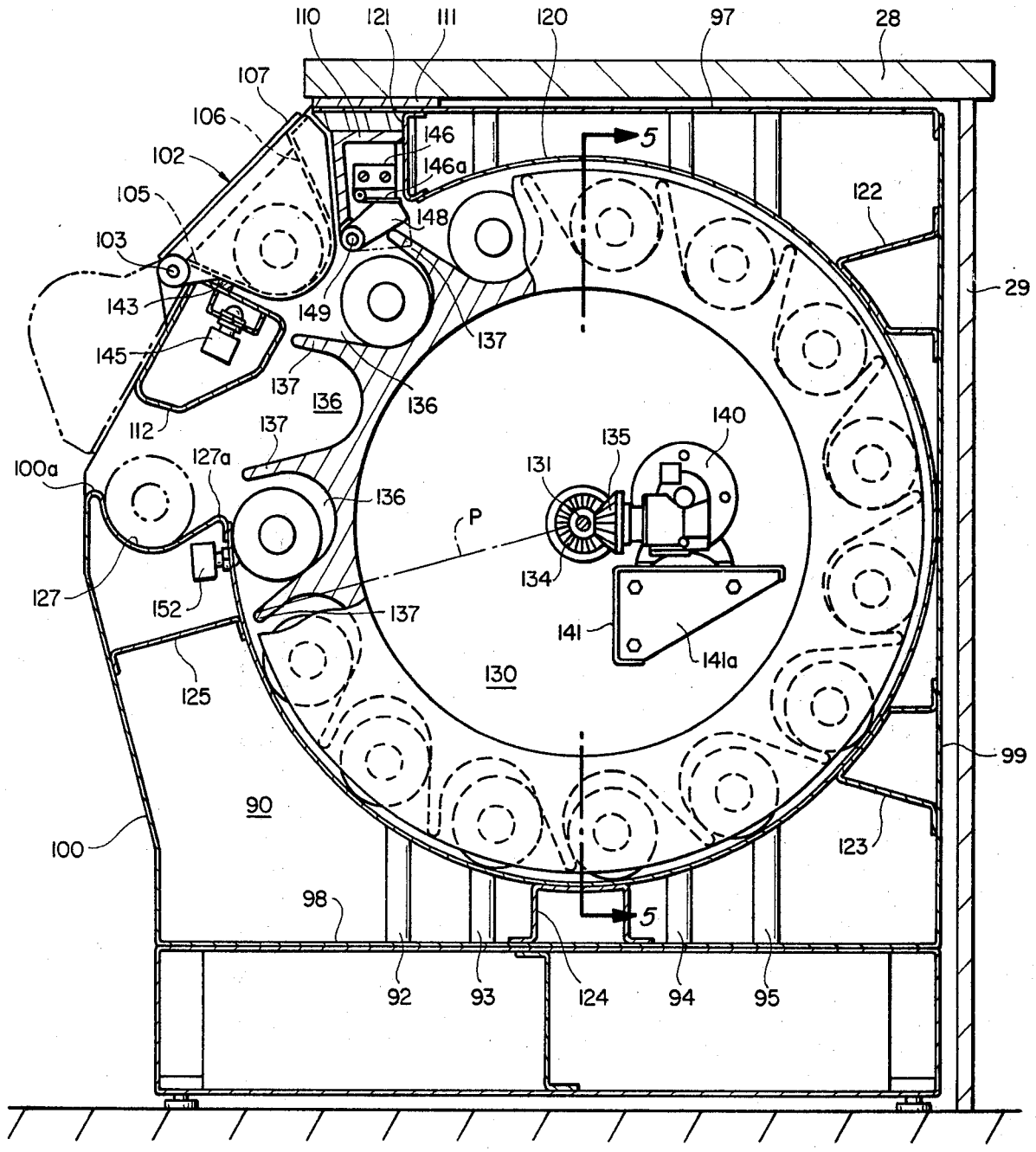
FIG. 4 is a vertical section taken along line 4—4 of FIG. 1.

The module 32 has two parallel, relatively thin spaced metal walls 90 and 91 (FIG. 5), each of which has four vertically disposed stiffening channels 92–95 (FIG. 4) secured to and projecting inwardly therealong. The module has a top wall 97 and a bottom wall 98 connected by the eight channels 92–95 to which the walls are secured, as by welding, and by a rear wall 99. A front wall 100 of the module is integrally formed with the bottom wall 98 and projects upwardly to terminate in an inwardly curved edge 100*a*. An access opening 100*b* (FIG. 1) is formed in the front wall between spaced wall sections 100*c* and 100*d* that extend to the top wall 97 to which they are welded. An access door 102, in the form of an elongated display compartment that extends across the upper portion of the opening 100*b*, is pivotally mounted at its lower side edges on rigid tabs 103 that are secured to and project outwardly from the wall sections 100*c* and 100*d*. As seen in FIG. 4, the compartment is a closed unit that includes a pair of spaced sidewalls 104 (one only being shown), inclined lower and upper walls 105 and 106, respectively, a curved bottom wall, and a cover 107 that is secured by screws to flanges formed integrally with the lower and upper walls. The cover, which is made of metal, has a central panel of glass or transparent plastic so that a bottle disposed in the compartment with its label facing outwardly of the compartment can be easily inspected. A key lock 108 (FIG. 1) is mounted in a corner of the cover 107 adjacent a recessed handle 109. The bolt of the lock engages a locking plate mounted in a bracket 110 (FIG. 4), that is secured to the undersurface of top wall 97, and to a spacer member 111 disposed between the wall 97 and the countertop 28. A microswitch (not shown) is mounted in the compartment in position to be actuated by a bottle placed in the compartment. The contacts of the switch are connected in a circuit which is effective to generate a signal indicating that the bottle has been removed from the compartment. Under normal operating conditions, a different bottle is displayed in each compartment to indicate the type and brand of liquor in the particular module. If a situation arises in which all the bottles in the module have been used and the bottle of that liquor that is in the well becomes empty, the bottle in the display compartment may be removed and used.

The part of the front wall opening 100*b* (FIG. 1) that is below the lower edge of compartment 102 is partly closed by a box-like member 112 which has side edges that underlie and are secured to the wall sections 100*c* and 100*d*, and has a panel 102*a* on its front wall adapted to carry indicia such as the word "RUM". A push button 113, which is mounted in the front wall, has a translucent panel, and includes a light which, when energized, will illuminate the panel. A small, fixed panel 102*b* disposed alongside the button 113 has a numeral inscribed thereon and this numeral will identify the module for control purposes. In FIG. 1, module number 3 has been assigned to store bottles of rum.

A partially cylindrical sheet metal wall 120 (FIG. 4) is mounted in fixed position inside the module, being welded to flanges formed on a plurality of brackets 121–125 that extend inwardly from the top, rear, bottom and front walls of the modules. The wall 120 is open at its front side, one transverse front edge of the wall being secured to the bracket 121 and the other edge being secured to a flange formed on an inner corner 127*a* of a cradle 127 formed by an inturned section of the front wall of the module. This cradle 127 is curved downwardly to form a receptacle for receiving individual bottles as they are dispensed one at a time by a dispensing drum 130 that has a cylindrical hub 130*a* (FIG. 5) pinned to a shaft 131. The shaft extends between the side walls 90 and 91 and is journaled for rotation in bearings 132 and 133 that are held in fixed position on the walls by mounting plates 132*a* and 133 respectively. The drum has a transverse web 130*b* and a plurality of radially disposed stiffening webs 130*c* (two only being shown). A cylindrical wall 130*d* coacts with annular end walls 130*e* and 140*f* to define an annular chamber, and this chamber is divided into a plurality of storage compartments 136 (FIG. 4) by a plurality of equally-spaced outwardly projecting walls 137. In the illustrated embodiment of the drum, there are 15 partition walls with 14 storage compartments 136. As viewed in FIG. 4, the drum is arranged for clockwise rotation on its shaft 131, and each partition wall 137 is so inclined relative to a radial plane P passing through its outer edge that, when the outer edge reaches a position adjacent the edge 127*a* of the cradle 127, the wall provides a ramp down which the bottle in the storage compartment adjacent the wall can roll for discharge into the cradle upon registry therewith.

The drum is rotated by a motor 140 which is supported on a bracket 141 and drives the drum shaft 131 through a set of bevel gears 134, 135. The bracket is provided with a flange plate 141*a* that is bolted to adjacent stiffening channels 94 and 95 of wall 90.

At the front of the unit, the space between the switch-mounting bracket 110 and the box member 112 defines a loading passage, and it will be noted that the display door 102 is mounted for movement from the full line position of FIG. 4 in which the passage is closed and the wall 105 of the unit rests on a stop plate 143 mounted on the unit 112, to the phantom-line position in which the passage is open and the cover of the door 102 rests on the forward wall of the unit 112. When the door 102 is in the open phantom-line position, an actuator-button of a jog switch 145 is accessible to the operator. This jog switch is used to index the drum during the period when bottles are individually being moved through the loading passage during a drum-loading operation.

Immediately above the passage, switch 146 is mounted on a web portion of bracket 110. The actuator arm 146*a* of switch 146 is disposed in the path of upward movement of a pawl 148 which is pivoted on a pin 149 carried by bracket 110 for movement from the full line position of FIG. 4, in which it has engaged and moved arm 146*a* to switch-actuating position, to the phantom position in which it is in the path of movement of the drum partitions 137. The pawl is normally urged clockwise to the phantom-line position by a conventional torsion spring (not shown) that is disposed around the pivot pin 149 and has end portions engaging the bracket 110 and the pawl. A stop member (not shown) limits the clockwise pivoting movement of the pawl to the phantom-line position. It will be evident that, when the drum is rotated clockwise, each partition 137 will in turn engage and swing the pawl 148 upwardly to actuate the switch 146 to initiate a control operation. When the partition passes out of engagement with the pawl, the pawl is moved downwardly to the phantom-line in which it will prevent any possible counterclockwise rotation of the drum.

A switch 152 is mounted just below the cradle 127 on the cylindrical wall 120 of the module, and the actuating plunger of the switch is normally urged outwardly so that a bottle in any storage compartment will engage the plunger and move it inwardly to actuate the switch.

Figure 6:
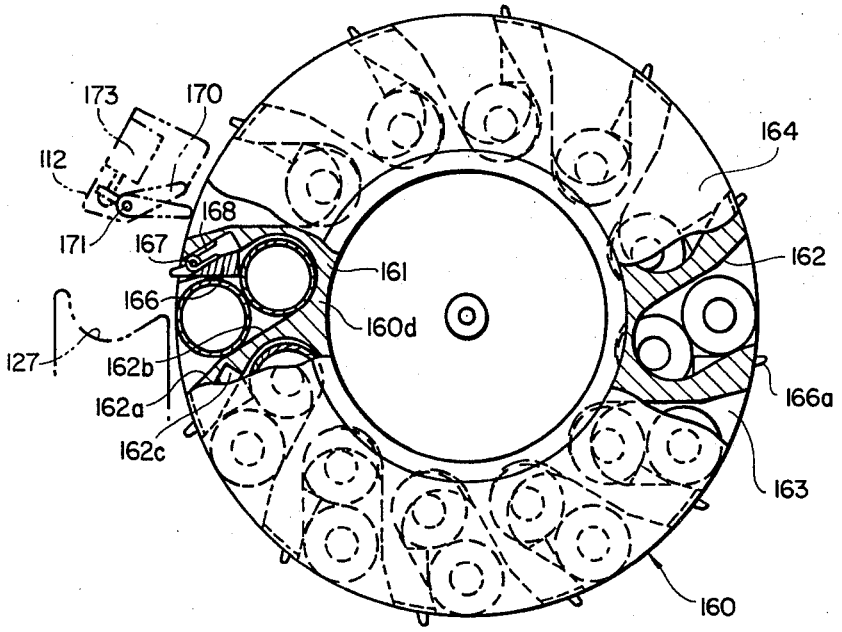
FIG. 6 is a fragmentary vertical section similar to FIG. 4, showing a second embodiment of the bottle storing and dispensing drum of the present invention.

In FIG. 6, a second embodiment 160 of the storage drum is illustrated. It will be understood that this drum is designed and dimensioned to be bodily substituted for the drum 130 of FIG. 4 and to be pinned in driven engagement on shaft 131. Further, this modified drum 160 is adapted to coact with the switches, the door and the other members of the assembly of FIG. 4 in exactly the same manner as does drum 130.

In general, the drum 160 has a cylindrical wall 160*d* that is smaller in diameter than the wall 130*d* of drum 130 so that the storage compartments, defined between the partitions and the end walls 163 and 164, are deep enough to receive two bottles. The leading face of each partition has an outer portion 162*a* that is inclined at a greater angle relative to a radial plane of the drum than the inner portion 162*b*.

The drum 160 is arranged to rotatate clockwise (FIG. 6) and the trailing side of each partition 162 has a recess 162*c* formed therein. A pawl 166 is pivotally mounted on a pin 167 that extends between the end walls 163 and 164, and a torsion spring 168 disposed around each pin 167 urges the pawl clockwise on that pin to the position illustrated by the pawl shown in section in FIG. 6, against a stop (not shown). One end 166*a* of each pawl extends radially outwardly past the periphery of the drum and, during rotary indexing movement of the drum, the arm will engage an actuator 170 if the actuator has been moved to a position in the path of movement of the pawl. The actuator 170 is pivoted on a pin 171 that is secured at its ends in the end walls of the box unit 112. The actuator has an end portion connected to the plunger of a solenoid 173 which is mounted in box 112.

The drum 160 is arranged to store 24 bottles. When the drum is empty, the first bottle moved into an empty storage compartment will actuate the pawl associated with that compartment, pivot it counterclockwise and pass to a position inwardly thereof. The spring loaded pawl will return to its initial position and the inner face of the pawl will prevent the bottle from moving out of the compartment. After the innermost bottle has been loaded into a compartment and locked therein by the associated pawl, the outer bottle can be directed into the compartment and it will be retained therein during subsequent rotary indexing of the drum by the cylindrical wall 120.

The bottles of the outer ring of bottles are dispensed in the same manner as the bottles of drum 130. After the twelfth bottle has been dispensed and the drum has come to rest, a signal is received from a control unit, that will be described presently, and the solenoid 173 is energized to swing the arm 170 to the phantom-line projected position. Then, when the drum is next indexed, the projection 166*a* of the pawl holding the bottle in the inner position will engage the arm 170, and the pawl will be rotated counterclockwise to release the bottle. The bottle will roll down the inclined wall sections 162*b* and 162*a* of the partition 162. The steepness of inclined section 162*a* will permit the bottle to drop out of the moving pocket of the drum without becoming locked against the solenoid arm 170.

The empty bottle disposal unit 24 includes a base 182 (FIG. 7) made up of front, rear, top and bottom sheet metal walls 183–186 respectively and two sidewalls 187 and 188 (FIG. 1) that extend upwardly above the base and form the sidewalls of the entire unit. Insulating material (FIG. 7) is disposed in the base as is a structural angle 190 which extends vertically in the compartment between the top and bottom walls to resist downwardly directed loads. The upper part of unit 34 is in the form of a housing which rests on base 185 and includes a front wall 192 and a rear wall 193 which is secured to base 185 and extends upwardly therefrom. This rear wall has spaced front and rear panels 195 and 196 enclosing insulating material. A pair of generally horizontal panels 198 and 199 are secured to and extend forwardly from the upper edges of panels 195 and 196 respectively and provide an insulated top wall 200. Panels 202 and 203 depend from the forward edges of panels 198 and 199 respectively to define a forward insulated wall 204 that has a forwardly inclined lower portion 204*a*. The top wall 200, rear wall 193, and front wall 204 cooperate with the sidewalls 187 and 188 to define a chamber in which is slidably disposed a rigid container 207 that is rectangular in horizontal section, rests on a plurality of I-beams 209, and has an open top. A rigid pad 221 of sound-insulating material is secured to the forward wall 215 of the container 207.

Figure 7:
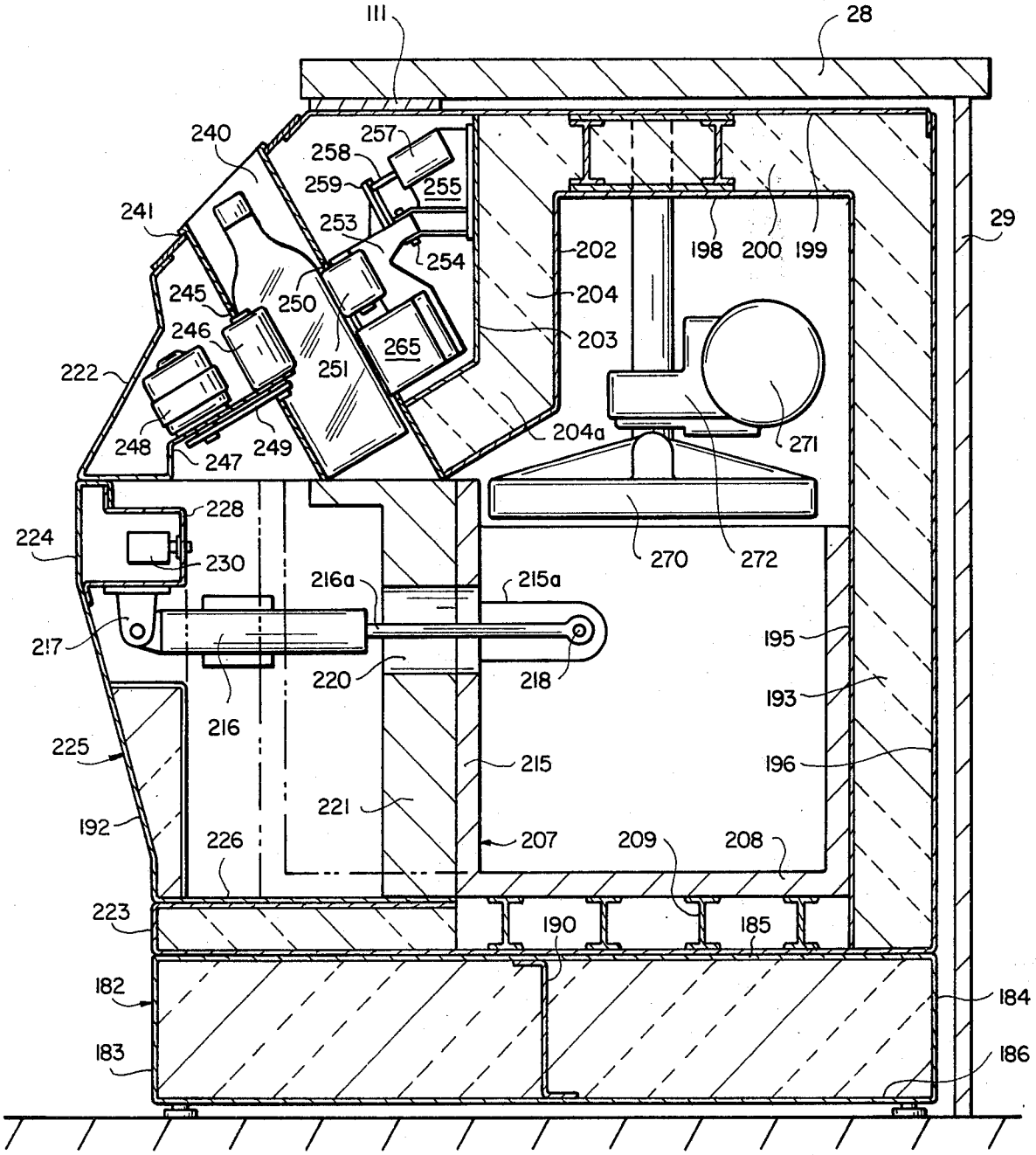
FIG. 7 is a vertical section taken along line 7—7 of FIG. 1.

The front wall 192 of the housing of the bottle disposal unit 24 includes an upper irregularly-shaped sheet metal section 222, a lower section 223 that is secured to the base 185, and an intermediate section 224 that is the front panel of a removable unit which includes a handle 231 and a pair of cylinders 216 that are located closely adjacent the opposite side walls of the unit and extend rearwardly from the front panel for connection to the container 207 (FIG. 7).

Each power cylinder 216 is pivotally connected to a bracket 217 depending from a rigid channel 228 that extends across the forward portion of the unit. Each piston rod 216*a* extends through an opening 220 in the insulation pad 221 and through an opening in the forward wall 215 of the container. At its innermost end, each rod is pivotally attached at 218 to a bracket 215*a* (one only being shown) that is mounted in a recess in a side wall of the container. When the two cylinders 216 are simultaneously energized, the container 207 will be moved to the left (FIG. 7) to a position wherein wall 215 assumes the position indicated in phantom lines.

When the container is in the phantom line, retracted position, it can be slid further outwardly of the cabinet by the operation of gripping the handle 231 and sliding the panel 224 outwardly, thereby pulling the container with the panel. When the container is far enough out of the cabinet, a liner (not shown) of heavy flexible material, which is removably suspending in the container, as by inwardly projecting hooks, may be removed with its contents and a new liner installed.

Referring to FIG. 7 it will be seen that when the container 207 is in its full-line position, it is rearwardly of one of two alternatively used tubular chutes 240 formed in the upper front wall section by generally cylindrical sheet metal members that are secured at their upper ends in circular openings 241 in the front wall of the housing and at their lower ends to the inclined portion of the insulated wall 204. When the power cylinder 216 is actuated to move the door to its retracted, dotted-line position, the container is moved to a position under the passages 240 and, as seen in FIG. 1, a bottle dropped into one of these passages can slide downwardly and pass into the trash, container 207 passing between the spaced piston rods 216*a*.

An opening 245 is provided in one side of each chute 240 and a drive roller 246, which is mounted on a bracket 247, projects a short distance into the chute in a position to engage a bottle deposited in the chute with its lower end resting on the door. The roller is driven by a motor 248 through a belt 249. A second opening 250 is provided in the opposite side of the chute and an idler roller 251 is arranged to be projected through this opening into contact with a bottle after the bottle has been positioned against the drive roller 246. The idler roller is rotatably mounted between projecting arms of a support member 253 that is pivotally mounted on a pin 254 carried by a bracket 255 secured to the wall 204. A solenoid 256 that is also mounted on the bracket 255 has a plunger 258 that engages a post 259 on the support member 253. The post is spaced from the pivot pin 254, and the solenoid is so oriented that when the solenoid is energized and the plunger is projected out of the solenoid housing, the support member is pivoted about pin 254 to move the idler roller through the opening 250 into engagement with a bottle in the chute. A label reader 265 is also mounted on the pivoting support member 253 opposite the opening 250. When the member 253 is pivoted by the solenoid to move the idler roller into engagement with a bottle in the chute, the reader is moved into close proximity to the surface of the bottle so that, as the bottle is rotated, the label moves past the reader. Each label is provided with a printed bar code that indicates a particular kind of liquor, that is, there is a separate bar code for vodka, one for whisky, and one for rum in the three module unit that is described herein. Since the labels will be applied to the bottles only by authorized persons, it is impossible for bottles of a different type or grade to be substituted for the authorized brands. The reader includes a pick-up or reading head of the type marketed by Data Terminal Systems of Maynard, Mass. The label, of course, must be located within a predetermined distance range above the bottom of the bottle and the bar code must be so oriented that the bar code will be propertly presented to the reading head in the reader 265. The labels are of the type that cannot easily be removed from the bottle and, if desired, the bar code can include coded data indicating lot number, date, person that loaded it, and the like. To stabilize the bottle in the chute, a second idler roller (not shown) is mounted adjacent the chute and arranged to project a short distance into the chute to engage a bottle therein. When a bottle is dropped into the chute it engages a switch (not shown) which causes the solenoid 257 to swing the idler roller into the chute and the label reader to be moved to label-reading position. When the reader is in place, the drive roller 246 is rotated a predetermined number of times so that the label passes by the reader.

It is evident that bottles sliding down the chute 240 may be suitably broken when they land in the trash container. In addition, a crusher (FIG. 7) may be mounted in the upper end of the compacting chamber. This crusher may be of the conventional design wherein an electric motor 271 rotates a nut (not shown) through suitable gearing in a housing 272. The nut rotates in place and causes a screw to move up or down. A platen 270 carried on the lower end of the screw is thus arranged to move downwardly to engage and crush bottles in the compacting chamber. The container 207 is, of course, wide enough so that the platen 270 will pass down inside and between the two piston rods 216*a*. To resist the vertical forces generated during the crushing operation, the upper and lower walls must be made strong to react to these forces as by suitable structural members.

Figure 8:
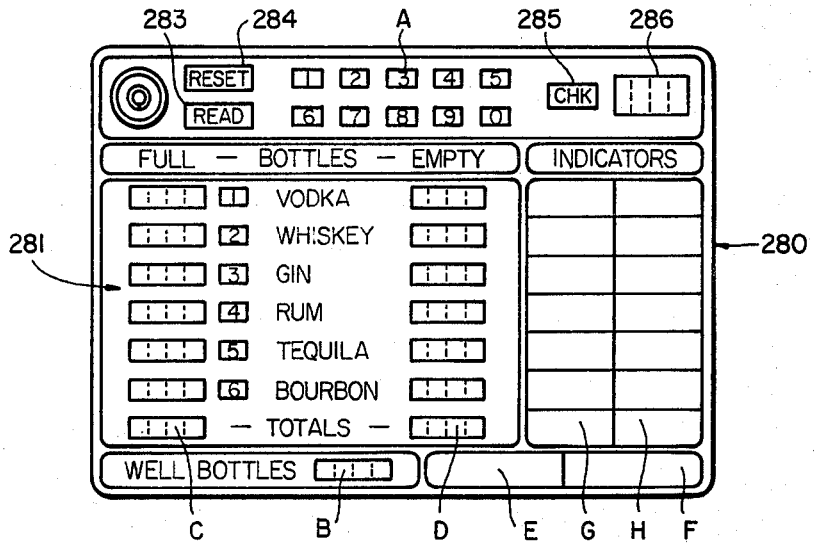
FIG. 8 is a front elevation of a control unit used in the system of the present invention.

In FIG. 8 is illustrated the readout panel of a control unit 280 which is mounted in the housing of the bottle disposal unit 24 with the readout panel 281 of the unit disposed in an opening in the front wall of the disposal unit 24. As will be explained presently, this control unit is in effect a bookkeeping unit where the various signals from the other components are processed and decisions are made in controlling the sequence of system activities. Also, in this unit the signals are stored and processed to provide the inventory and accounting data summaries desired. The electronics providing these functions are known and are everyday technology. While various system may be used to carry out these functions, one system particularly adapted for the liquor control system disclosed herein is that marketed by Data Terminal Systems of Maynard, Mass. as Series 515.

The control unit 280 has the ability to receive and store the electronic signals from the label reader and to assign each of the electric "photos" of the three modules. This is accomplished by placing a sample bottle in the bottle chute 240, depressing the "read" button 283 on the panel 281 and depressing the appropriate module button A. As the sample bottle rotates past the reader, a signal from the reader is stored in the unit for comparison with signals received later when empty bottles in the chute 240 are scanned by the reader.

The readout panel 281 also is provided by a row C of dials in which the number of full bottles in the dispenser is continuously displayed, as well as a row D where the number of empty bottles is shown. A dial B indicates the number of bottles in the well. A panel E is arranged to be illuminated to indicate to the operator that the compacter receptacle 207 is full of crushed glass and must be emptied, while a panel F is illuminated when the compactor is in operation. One panel of a vertical row G of panels is illuminated when there is a malfunction in one of the dispenser modules, and one panel of a vertical row H will indicate when a module must be reloaded. A "reset" button 284, and a "check" button 285 are also provided on the readout panel. A dial 286 is arranged to indicate the open or closed condition of the well door. The dials and panels may be translucent members having indicia inscribed thereon that may be illuminated when associated lights are energized or they may be light-emitting-diode displays or similar display arrangements.

It will be understood that while a three module system has been shown and described for convenience in disclosing the invention, a larger or lesser number of modules could be incorporated in the system of the present invention and, as indicated in FIG. 1, the modules of the bottle dispenser 22 and the unit 24 can be mounted on casters or wheels.

To put the three module system of FIG. 1 into operation, sample bottles of three different liquors are inserted one-by-one into the bottle chute and the read button 283 and the various module buttons A are depressed to associate one type of liquor with each module, as explained above.

The operator then loads each module with full bottles by first actuating the lock 108 of the display door of the appropriate module, as for example, module 32, FIG. 1 in which bottles of gin are retained. When the door is unlocked, it is swung down to the open position shown in phantom lines in FIG. 4. Assuming that all the pockets of the module drum 130 are empty and the drum has been stopped in the position shown in FIG. 4 with an empty pocket disposed directly opposite the access passage above the slanted wall of the box-like member 112, the next step is for the operator to allow a bottle of gin to roll down the passageway into the pocket. The operator then actuates the jog switch 145 to energize the motor 140 and index the drum through 24 degrees of clockwise rotation. As the drum indexes, the bottle engages and actuates switch 146 which counts the bottle and causes the control unit 280 to add the bottle to the inventory of bottles of gin in row C of dials on the readout panel 281 (FIG. 8). Additional bottles are introduced one-by-one into the module and the drum is indexed after each bottle is introduced to bring an empty pocket into position and to add one more bottle to the inventory in the gin dial of row C. The loading is continued until a bottle actuates switch 152. Actuation of this switch will indicate that the module is full. All of the other modules are filled in the same manner. The well W (FIG. 2) is then filled by placing one bottle of each of the three liquors in each compartment of the well. As each bottle is placed into the compartment, it actuates the associated switch 80 and a signal is sent to the control unit 280 to indicate at B on the readout panel the presence of another bottle in the well. Accordingly, at the start of a period during which a record is to be kept, each of the first three dials in column C could typically read "14", the dials in column D could read "0" and the dial B could read "3".

During the work period, whenever one of the bottles in the well becomes empty, for example, a bottle of gin, the operator removes the bottle and places it in the bottle chute of the disposal unit. When the bottle passes out of contact with the switch 80 in the well compartment, the dial B will indicate that one less bottle is in the well. When the empty bottle slides down the chute, it actuates the switch in the chute which starts the drive roller 246 and moves the reader into position against the bottle. After the bottle is rotated a sufficient number of times, the drive roller is stopped and the reader retracts. As the label is being read, the reader and the control unit cooperate to determine whether or not the bottle is one of those associated with one of the modules and, if so, which module it is. If the bottle is the proper gin bottle and has been accepted, the control unit actuates the power cylinders 216 to open the compactor door and permit the bottle to drop into the compacting chamber. After an interval sufficient for the bottle to reach the compacting chamber, the control unit energizes the power cylinders to close the door and energizes the compactor motor to start the compacting operation.

Also, the control unit causes the appropriate dial in column D on the readout panel to indicate that one "empty" bottle of that particular type of liquor has been deposited in the disposal unit. Also, when the label of an empty bottle is read and is electronically verified as being acceptable, a circuit to the associated module is activated, and the push button 113 (FIG. 1) is illuminated. To obtain a full bottle of gin from the module, the operator pushes button 113 to activate the drum motor 140 and cause the drum to be indexed through 24 degrees of clockwise rotation (FIG. 4). During this indexing movement the bottle of gin in the pocket of the drum, that registers with cradle 127, rolls into the cradle. The operator removes the bottle and places it in the appropriate compartment in the well. The dial B on the readout panel will then indicate that 3 bottles are in the well. The dial in column C opposite the word "gin" will indicate that there are now 13 full bottles in module "3", while the dial in column D will indicate that one empty gin bottle has been processed in the disposal unit. It will be evident that the bottles of the two other liquors are handled in the same manner as described for the bottle of gin and that the control unit will continuously monitor the disposition of empty bottles and the dispensing of full bottles and provide a visual record of the occurrences on the readout panel.

Figure 9:
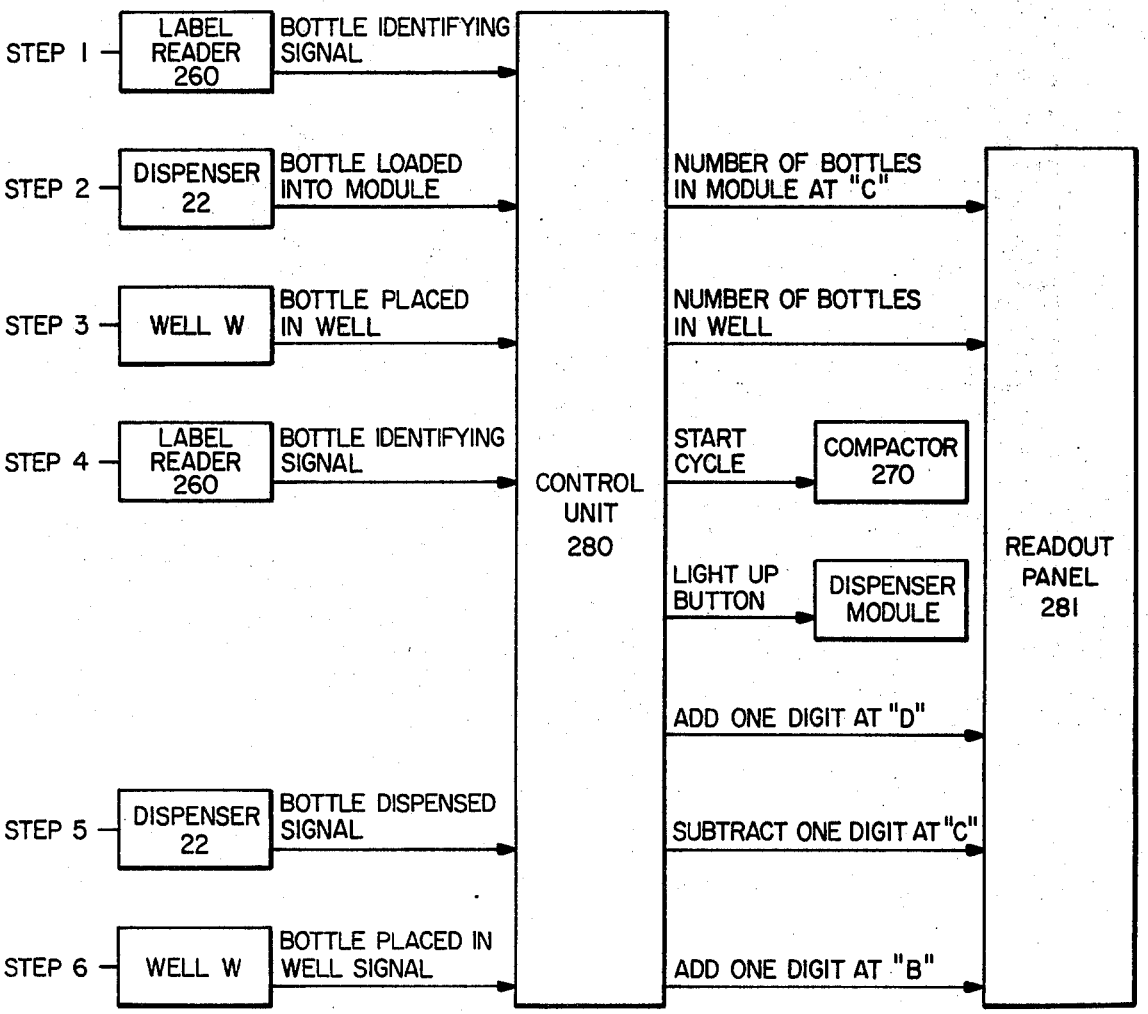
FIG. 9 is a diagrammatic showing of the various operations carried out by the system of FIG. 1.

FIG. 9 schematically shows the various operations performed during the use of the system of the present invention, particularly indicating the functions and capabilities of the control unit 280.

Steps 1–3 concern the initial loading of the system. In step 1, the operator presents a sample bottle to the label reader while pressing the "read" button and a particular module button and thereby causes the control unit to store a signal which associates the label with the particular module and which can be compared with signals received later from the reader when empty bottles are scanned. In this manner, each of the three modules is associated electronically with the label of a particular liquor. In step 2, the operator unlocks each module in turn, jogs the drum 10 of the module, and inserts a full bottle that has the label associated with that module into each compartment. As the drum rotates, the switch 146 at the entrance of the drum detects each bottle and sends a signal to the control unit which stores this information and causes it to be displayed on the appropriate dial in row C on the readout panel. In step 3, the operator places three bottles of liquor in the well and the switches in the well send signals to the control unit which stores them and causes the data to be recorded at dial B on the readout panel.

In step 4, the processing of an empty bottle of gin is schematically illustrated. The operator places the empty bottle in the chute 240 where it is rotated and scanned by the reader. The reader sends a signal to the control unit identifying the bottle. The control unit initiates a cycle in which the power cylinder is energized to open the door in the disposal unit, allow the bottle to drop into the compacting chamber, close the door and activate the compactor to crush the bottle. The control unit also illuminates the push button 113 of the gin module and activates a circuit which will result in the drum being indexed when the button is actuated by the operator. Also, the control unit indicates in column D of the readout panel that one empty gin bottle has been processed.

Obtaining a full bottle to replenish the well is carried out by step 5 wherein the operator pushes the button 113 of the gin module, causing the drum to index and a full bottle of gin to roll out into the cradle 127. Just before moving out of the drum, the bottle passes out of contact with switch 152, causing a signal to be sent to the control unit advising it that a bottle of gin is being dispensed. The control unit then subtracts one digit from the number of full bottles indicated to be present in column C of the readout panel.

Step 6 involves the operator removing the full bottle ejected by the dispenser and placing it in the well. When the full bottle engages the switch in the well compartment a signal is sent to the control unit and that unit changes the reading at dial B to indicate that there are now 3 bottles in the well.

In accordance with conventional practice the control system of the present invention is adapted to be connected with a printer, and in the present application of the system to the control of the dispensing of packaged goods provision is made for providing a print-out showing a summary of a particular bartender's performance during his tour of duty and at various times of the day. Also, the time at which the well door 47 is opened and closed may be recorded to show compliance with local ordinances.

In the illustrated embodiment of the invention, the control unit 280 is mounted in the housing of the disposal unit 24. It is within the scope of the present invention to locate the control unit at a place remote from the disposal unit, as for example, at a central computer station. Also, the control unit may take the form of a cash register unit which is connected to a printer and capable at any time of issuing a print-out showing the amount of money handled by the bartender, the number of drinks served by him, and the condition of the inventory in the dispenser unit, the well, and the disposal.

Further, the present system has been disclosed in connection with the dispensing of bottles of liquor. It will be evident that the concepts of the system could be applied to the control of the dispensing of other types of commodities in other types of packages such as cans, jars and the like. Accordingly, in the claims the term "packaged goods" will be used to include, within the purview of the claims, other types of containers whose dispensing can be controlled as disclosed herein.

While the modules and units of the present system have been illustrated as located in side-by-side relation, it will be evident that they may in fact be located in spaced relation, some units may even be at remote locations. When the units are located at spaced locations, they need only be interconnected only by electrical leads.

From the foregoing description it will be appreciated that the present invention provides a unique, effective system for maintaining a running record of bottles of liquor used during a given period. The mechanism for making available a fresh bottle of liquor of any particular type only when an approved empty bottle for the same liquor is accounted for makes possible an accurate control of full bottles of liquor, and the continuous record of the status of both the well bottles and the full bottles makes difficult the misuse of the bottles in the well.

We claim:

1. In a control system for packaged goods, a housing and bottle dispensing apparatus in said housing comprising a drum mounted for rotation about a generally horizontal axis in said housing, means defining a plurality of angularly-spaced, outwardly-opening elongate compartments disposed around the periphery of said drum, a releasable gate mounted in each compartment intermediate its length, the length of each compartment being such that a bottle lying on its side can be stored therein inwardly of said gate and one can be stored therein outwardly of said gate, means urging each gate to a position in its compartment extending into the path of movement of a bottle moving outwardly of the compartment, said means being yieldable to permit a bottle to be moved inwardly into the compartment during a loading operation, means for directing bottles into said compartments to form a circular array of bottles inwardly of said gates and one outwardly of said gates, means defining a discharge passage in said housing adjacent the periphery of said drum, each compartment being inclined in a direction to cause a bottle to move out of the compartment when the compartment becomes aligned during rotation of said drum with said discharge passage, means for rotating said drum to cause the successive discharge of the bottles in the outer sections of said compartments, and means effective during continued rotation of said drum to release the gate of each compartment as it moves to an aligned position with said discharge passage to permit the outward movement of the bottle in the inner section of the compartment.

2. In a control system for packaged goods, a housing and bottle dispensing apparatus in said housing comprising a drum mounted for rotation about a generally horizontal axis in said housing, means defining a plurality of angularly-spaced, outwardly-opening elongate compartments disposed around the periphery of said drum, a releasable gate mounted in each compartment intermediate its length, the length of each compartment being such that a bottle lying on its side can be stored therein inwardly of said gate and one can be stored therein outwardly of said gate, and means urging each gate to a position in its compartment extending into the path of movement of a bottle moving outwardly of the compartment, said means being yieldable to permit a bottle to be moved inwardly into the compartment during a loading operation.

3. In combination, a bottle dispensing mechanism, adapted to store bottles of selected classifications, bottle disposal apparatus adjacent said dispensing mechanism, a receptacle in said disposal apparatus adapted to receive discarded bottles, a movably-mounted gate in said disposal apparatus controlling access to said receptacle, and control means for identifying a bottle of one of the selected classifications when the bottle is placed in said disposal apparatus and moving said gate to open position to provide access to said receptacle, said disposal apparatus including a guide chute above said gate and arranged to direct a bottle to a position partially supported by said gate whereby when said gate is moved to open position the bottle drops into said receptacle.

* * * * *